US007770238B2

(12) United States Patent
Dayan

(10) Patent No.: US 7,770,238 B2
(45) Date of Patent: Aug. 10, 2010

(54) NECKTIE WITH PERMANENT KNOT

(76) Inventor: Edward Dayan, 20 W. 33rd St., 12th Floor, New York, NY (US) 10001

( * ) Notice: Subject to any disclaimer, the term of this patent is extended or adjusted under 35 U.S.C. 154(b) by 562 days.

(21) Appl. No.: 11/019,957

(22) Filed: Dec. 22, 2004

(65) Prior Publication Data

US 2005/0204450 A1 Sep. 22, 2005

Related U.S. Application Data

(60) Provisional application No. 60/532,170, filed on Dec. 22, 2003.

(51) Int. Cl.
*A41D 25/02* (2006.01)

(52) U.S. Cl. ..... 2/148

(58) Field of Classification Search ..... 2/144–150, 2/152.1, 153, 155–157; 24/49.1, 50
See application file for complete search history.

(56) References Cited

U.S. PATENT DOCUMENTS

| | | | | | |
|---|---|---|---|---|---|
| 1,396,240 | A * | 11/1921 | Bakerman | | 2/150 |
| 1,400,858 | A * | 12/1921 | Boros | | 2/150 |
| 1,614,882 | A | 1/1927 | Crouch | | |
| 2,553,437 | A * | 5/1951 | Burke | | 2/150 |
| 3,127,618 | A * | 4/1964 | Roach | | 2/150 |
| 3,263,237 | A | 8/1966 | Bellon | | |
| 3,898,698 | A * | 8/1975 | Byrd et al. | | 2/150 |
| 3,946,444 | A | 3/1976 | Parrilla | | |
| 3,955,217 | A | 5/1976 | Levy | | |
| 4,246,658 | A | 1/1981 | Liaw | | |
| 4,318,189 | A | 3/1982 | Intengan | | |
| 5,295,270 | A | 3/1994 | Phillips et al. | | |
| 5,600,851 | A | 2/1997 | McLeod | | |
| 6,460,189 | B1 | 10/2002 | Welch | | |
| 6,871,358 | B2 * | 3/2005 | Galante | | 2/149 |

FOREIGN PATENT DOCUMENTS

| | | |
|---|---|---|
| GB | 2259440 | 3/1993 |

* cited by examiner

*Primary Examiner*—Tejash Patel
(74) *Attorney, Agent, or Firm*—Pearl Cohen Zedek Latzer, LLP

(57) ABSTRACT

A necktie is disclosed having a knot, the knot having a channel. The necktie has a unitary band, the band being a separate material from the knot. The band has two circumferential segments, each segment being threaded through the channel. Each segment of the band is capable of sliding within the channel. The band is without a clasp on the back outer surface of the knot. The necktie has an elastic textile fabric, within the knot, that is capable of restraining the motion of the band.

30 Claims, 2 Drawing Sheets

NECKTIE WITH PERMANENT KNOT

RELATED APPLICATIONS

The present application claims the priority of U.S. Provisional Application Ser. No. 60/532,170 filed Dec. 22, 2003, which is fully incorporated herein by reference.

FIELD OF THE INVENTION

The present invention relates generally to a necktie and more specifically to a tie having a permanent knot and an adjustable neckband.

BACKGROUND OF THE INVENTION

In the past, there have been numerous types of simulated knotted neckties. The simulated ties are intended to replace traditional neckties that are tied by hand, and have knots with various styles. In one type of design, known as a "clip-on tie", the simulated tie has a clasp in the form of a metal clip which attaches to the user's shirt collar, above the top button. In another type of design, the simulated tie typically has a neck strap or band forming a opening. The tie also has a knot that is capable of moving relative to the neck strap for increasing and decreasing the size of the opening. The opening of the neck strap is increased for allowing the tie to slip on and off of a head of a person. The opening of the neck strap is decreased for allowing the knot to be placed comfortably against the neck of a person wearing the tie.

There is a need, however, in the art for a simulated necktie of improved design, which closely approximates the outer appearance of a traditional (hand-tied) necktie, which avoids the use of an outer clasp on the back surface of the knot, and which is preferably suitable for the use of children.

SUMMARY OF THE INVENTION

In accordance with the present invention, a necktie is provided which is simulated to appear like a necktie which has been tied by hand, but without a clasp on the outside back surface of the knot. The necktie includes a knot tied to provide the appearance of a Windsor knot (or other desired knot design). The knot further includes a channel inserted therein.

The necktie also includes a band, the band being a separate material from the knot. The band has two circumferential segments (a left and right segment), each segment being threaded through the channel. Each segment of the band is capable of sliding within the channel. In the preferred embodiment, the necktie further includes an elastic member within the knot capable of restraining the motion of the band.

BRIEF DESCRIPTION OF THE FIGURES

In order that the manner in which the above-recited objectives are realized, a particular description of the invention will be rendered by reference to specific embodiments thereof that are illustrated in the appended drawings. Understanding that the drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION AND THE PREFERRED EMBODIMENTS

Figure 1:
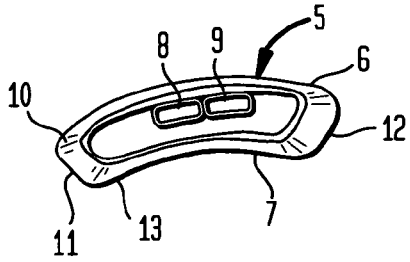
FIG. 1 is a top view of a channel the knot of the necktie according to the invention.

A simulated necktie 1 is described having a knot 2, a front face 3 and a band 4. Front face 3 is the front display face of the necktie, i.e. the front length of material extending down from the knot 2. The band 4 is independently adjustable from the front face 3 or the knot 2. Preferably, the band forms a single length of material (is unitary), with the top end of the band forming a loop with an opening 30, and the bottom end of the band extending out of knot 2. Opening 30 formed by band 4 can be lengthened to remove the necktie from the head of a person without the need for a clasp affixed to the back of the knot 2.

In the preferred embodiment, knot 2 is tied in the appearance of a full Windsor knot. Alternatively, the knot can be tied in another desired knot style. In accordance with the design of the invention, the shape and appearance of the front of the knot (the side which is visible when the necktie is being worn) is the same as that of a traditional necktie, i.e. that of a necktie consisting of a length of fabric tied by hand. In other words, from the front of the tie, the knot appears to be one which has been tied by hand. Preferably, the back of the knot also presents an appearance as if the necktie has been tied by hand; although further preferably, one or two stitches can be used on the back of the knot to secure the shape of the knot in place. These stitches function, for example, to prevent the knot from being pulled apart accidentally, or being pulled apart due to the curiosity of a child.

More specifically, the necktie 1 has a permanent knot 2 and a front face 3 extending out of the knot. The band 4 forms a opening, with the band 4 being fabricated separately from the knot 2 and front face 3. Knot 2 of the necktie has a channel 5, and at least one elastic member 8 that restrains the movement of the band. Preferably the elastic member is made of fabric.

Channel 5 is inserted within knot 2, with the knot 2 being wrapped around the insert. In the preferred embodiment, the insert includes a single channel 5 with both segments of the band (i.e. the right and left sides of the loop) passing through that single channel. Alternatively, the insert can include two channels, with each segment passing through a separate channel.

The elastic member (8 and/or 9) is preferably secured to channel 5, and preferably tightens the band against channel 5, restraining the movement of the band within the knot. One elastic member 8 can be utilized, or multiple elastic members 8 and 9 can be used. For example, one elastic member 8 can be folded over into a circle and affixed to the channel 5 using a bolt 20 (e.g. a stud or post) in the center of the member 8 (or using stitching in the center of the member 8). The stud, post or stitching thereby divides the folded elastic member, forming two spaces or channels between the elastic member and channel 5 (i.e. a left channel of the elastic member and a right channel of the elastic member). Each side of the band is threaded through the channel 5 and placed between the channel and elastic member before the stud is affixed, so that the band is held in place by the channel and elastic member. Alternatively, two separate elastic members 8 and 9 can be utilized. Accordingly, it will be understood that future references to elastic members 8 and 9 can refer to two separate elastic members or to the left and right portions of a single elastic member.

Thus, the band is threaded through the channel 5, and through the channels in the elastic member 8, with the channel and elastic member guiding the band, and with the elastic member restraining the movement of the band. This restraint provides tension to assist in maintaining the opening 30 in a desired diameter, whether in an enlarged size diameter to put on the tie, or in a reduced size diameter when the tie is being worn. Adjustment of the opening 30 in the band 4 makes tie 1 capable of being slipped over the head of a person and the knot 2 capable of being placed against the neck of a person. The tie 1 does not need a clasp to accommodate slipping over the head of a person.

Turning to FIGS. 1, 2, 3, and 4 there is illustrated a top, rear, side and front view of channel 5. Channel 5 is an insert placed within knot 2 which provides the shape to the knot 2 of the tie 1, and which provides a guideway that the band is threaded through. Band 4 is threaded through the channel 5 (and through the additional channel in the elastic member affixed to the channel 5), with the band 4 creating a loop for slipping the tie 1 over the head of a person. In accordance with the invention, the loop can be adjusted in length to adjust the size of the loop's opening 30 to fit the neck of the person. The channel 5 is preferably fabricated from a material that is rigid enough to maintain the shape of the knot 2 through many uses of the tie 1. For example, in one preferred embodiment, the channel 5 is fabricated from plastic, and can have a thickness of approximately 1/32nd of an inch.

Figure 2:
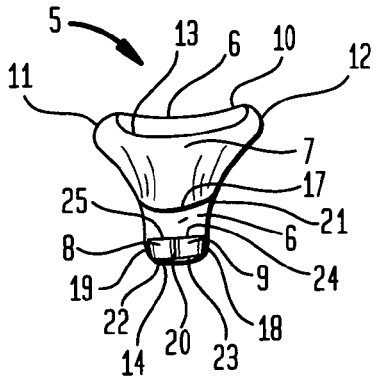
FIG. 2 is a rear view of the channel within the knot.
Figure 4:
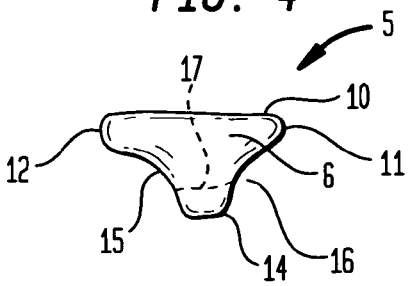
FIG. 4 is a front view of the channel within the knot.

The channel 5 has a front face 6. Front face 6 is preferably curved in the form of a desired necktie knot, e.g. in the shape of a traditional full Windsor knot. Further preferably, channel 5 is Y-shaped as shown in FIGS. 2 and 4. The front face 6 has a first side edge 11 and a second side edge 12. The first and second edges 11 and 12 are dimensioned to have a length sufficiently large to allow band 4 to be threaded through the channel 5. The edges 11 and 12 are dimensioned to allow the band 4 to be capable of freely traversing through the channel 5. In a children's tie, the first and second edges 11 and 12 have a length of approximately 3/8ths of an inch.

Between the first and second side edges 11 and 12 is a front top edge 10. The top edge 10 creates the top span of the Windsor knot. In a children's tie having a Windsor knot, the top edge 10, between edges 11 and 12, can have a span of approximately two inches. The top edge 10, along with the entire front face 6, bows outwardly to create the appropriate appearance of the front of the Windsor knot. For example, the top edge can bow outwardly from the front of edges 11 and 12 by approximately one quarter of an inch.

Figure 3:
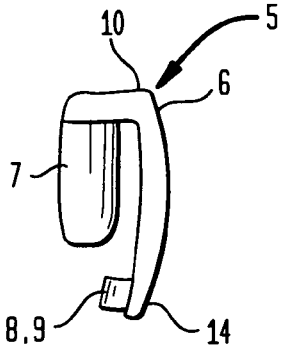
FIG. 3 is a side view of the channel within the knot.

The front face 6 has a bottom edge 14 (FIGS. 2-4). The distance between the top edge 10 and the bottom edge 14 defines the height of the knot. In a child's tie having a Windsor knot, the height of the knot, between top edge 10 and bottom edge 14, is preferably approximately one inch. The bottom edge 14 has a length sufficiently long in view of the size of the two segments of the band to allow those two segments of the band 4 to slide past the bottom edge 14 without excessive resistance. In a child's tie having a Windsor knot, the length of the bottom edge 14 is approximately one half of an inch.

The front face 6 has side edges 15, and 16 (FIG. 4). The side edges 15 and 16 each have a taper between the top edge 10 and the bottom edge 14. The taper defines the shape of the front of the Windsor knot. The taper is, for example, parabolic. Alternatively, the taper is angled. An angled taper would consist of a top segment that extends downwardly by one half of an inch and is forty five degrees from the top of the top edge 10. The remainder of the taper would consist of a segment that linearly connects the top segment to the bottom edge 14.

Attached to the inside surface of the front face 6, adjacent to the bottom edge 14, is elastic member 8 (or two elastic members 8 and 9), as shown in FIGS. 1-3. As discussed above, one elastic member 8 can be utilized which is folded over and bolted to the channel with a stud, or two separate elastic members can be affixed to the channel 5. For ease of reference, numerals 8 and 9 are used to refer to the right and left surfaces of the elastic member whether a single elastic member is used having a right and left surface (on each side of the stud) and a corresponding space between each of those right and left surfaces and channel 5, or whether two separate elastic members are used each member having a surface having a space between it and channel 5.

The surfaces 8 and 9 are attached to the channel 5 via a bolt 38 (e.g. a stud or post), or stitching, or fabric welding, or any other suitable means. The elastic members 8 and 9 are preferably fabric textile strips, such as spandex, through which the band 4 is threaded. The space between elastic member 8 and the channel 5 itself forms a channel for the band 4 to be threaded beneath the elastic member 8 and above channel 5; likewise the space between elastic member 9 and the channel 5 also forms a channel for band 4. When the band 4 is threaded through channel 5, and through The members 8 and 9 restrain the motion of the band 4 so that the band 4 does not loosen after the band is adjusted to fit the neck of a person. The elastic members 8 and 9 stretch and are flexible enough so that the band 4 can be easily loosened around a head of a person and removed from the person without requiring a clasp.

The elastic members 8 and 9 each have circumferential surfaces 18 and 19 (FIG. 2). The surfaces 18 and 19 each have a length that allows the elastic members 8 and 9 to repetitively flex against the band 4 without tearing. For example, the surfaces each can have a length that is 3/8ths of an inch.

The elastic members 8 and 9 each have circumferential bottom edges 22 and 23, and circumferential top edges 24, 25. Each edge 22-25 has the same diameter and defines an opening for threading the band 4 through the surfaces 18 and 19. The diameters of each edge 22-24 are preferably smaller than the width of the band 4, so that the flexible members 8 and 9 continually flex against the band 4 and restrain the motion of the band 4.

The amount of flex from the members 8 and 9 is that which prevents the band from slipping through the members 8 and 9 when the tie is tightened against the neck of a person. The members 8 and 9 are relaxed enough so that the band 4 may be loosened and removed from the head of a person without the need of a clasp. For example, the diameter of each edge 22-25 can be approximately 3/16ths of an inch.

The channel has a rear face 7 (FIGS. 1-3). The rear face 7 has a rear top edge 13, between the first and second side edges 11, and 12. The rear top edge 13, along with the entire rear face 7, has a contour that matches the contour of the front top edge 10. The channel defined by front and rear top edges 10 and 13, and side edges 11 and 12, defines the channel for threading the band 4.

The rear face 7 has a bottom edge 17 (FIG. 2). The bottom edge 17 is offset from the bottom edge of the front face 14. The distance between the bottom edges 14 and 17 is at least the length of the side of the elastic member 18, and 19. For example the distance between the bottom edge 14 and the bottom edges 17 can be approximately 3/8ths of an inch.

Preferably, the bottom edge has a length that is not greater than the length of the edge 17 as projected onto the front face 6, as illustrated in hidden lines on FIG. 4. Preferably, the length of edge 17 is limited to prevent the knot from bulking outwardly towards the back of the knot 2 when viewed from the front of the knot 2. For example, the length of the edge 17 can be approximately ¾ths of an inch.

The rear face 7 has side edges 24 and 25 (FIG. 2). The side edges 24 and 25 are each tapered between the top rear edges 13 of the channel and the bottom edge 17 of the rear face 7. The taper on edges 24 and 25 matches the taper on the front edges of the channel 15 and 16. The purpose of matching the taper is to prevent the bulking outwardly of the knot 2 when the knot 2 is viewed from the front face 6 towards the back face 7.

The rear top edge 13 (FIG. 2) is offset from the bottom edge 17 by a distance that allows the knot 2 to be repetitively used without bending or wearing. For example, the distance between the rear top edge 13 and the bottom edge 17 can be approximately ⅜ths of an inch.

Figure 5:
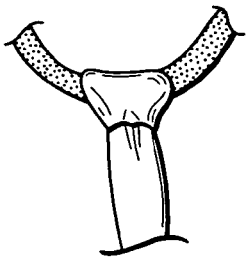
FIG. 5 is a front view of the necktie.
Figure 6:
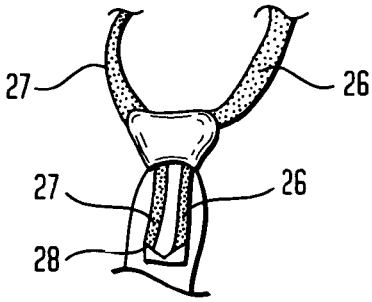
FIG. 6 is a rear view of the necktie with the neckband in an protracted position.
Figure 7:
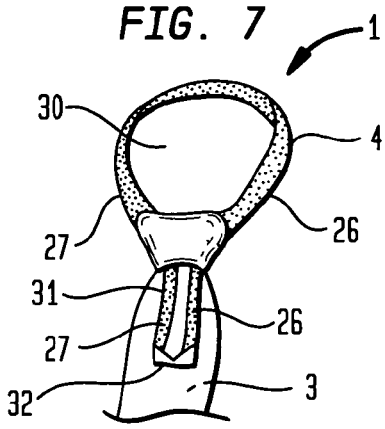
FIG. 7 is a rear view of the necktie with the neckband in a retracted position.

Turning now to FIGS. 5 through 7, the band 4 is illustrated. The band 4 is a cloth material and has a first and second circumferential sections 26 and 27. The first section 26 is threaded through one elastic member of the knot 8 and the second section 27 is threaded through the adjacent elastic member 9. The threading of the band through the elastic members 8 and 9 creates an opening 30 above the knot 2 and creates an extension section 31 (a tongue) below the knot 2. The extension section 31 is gripped by a person wearing the tie 1 for pulling the band through the elastic members 8 and 9 and tightening the opening 30 about the person's neck.

The length of the band 4 provides a maximum opening 30 that is greater than the diameter of the head of an average child of, for example 10 years old. Front face 3 of the tie is of a fixed length; unlike a necktie which is tied by hand, front face 3 cannot be accidentally made too long or short by the child but is set at a suitable size for the desired user. Preferably, the user is a child, although neckties in accordance with the invention can be provided for adults as well.

The length of band 4 is sized to prevent the extension section 31 from extending below the bottom of the front face of the tie 3 when a child wears the tie 1. As an illustration, when the opening of the band 31 is tightened about the neck of an average 10 year old, the bottom edges of the band 28 and 29 are both above the bottom edge of the front face of the tie 3. In other words, the extension section 31 in the back of the tie does not extend below the front face of the tie during use. For example, the length of the band, from the bottom edge 28, around the circumference of the opening, and to the bottom edge 29, can be approximately twenty nine inches.

Preferably, the band 4 has a thickness that is large enough to cause the continuous flexing of the flexible members 8 and/or 9. The thickness of the band 4 is continuous so that the resistance between the band 4 and the flexible members 8 and/or 9 is constant. For example, the thickness of the band is. ⅜ths of an inch.

Further preferably, the band has a hand grip 32 connecting the bottom edges of the band 28, and 29. The hand grip 32 is continuous with the band 4 and capable of being gripped by a child. The length of the hand grip, extending from the bottom edges of the band 28, and 29, is long enough to be comfortable in the palm of a child. For example, the length of the hand grip can be approximately two and a half inches. Preferably, the width of the grip is approximately twice the width of the band so that the grip can encompass both bottom edges of the band 28 and 29. For example, the width of the grip can be approximately one inch.

In use, the child grips the hand grip 32 with one hand and grips the knot with the other hand. This configuration allows the child to reduce the size of opening 30, to "tighten" the knot 2 about the child's neck. This way, the child is capable of secure the tie around his or her neck without tying a traditional tie, and without the aid of an adult.

The front face of the tie 3 is a cloth fabric that is the same material as the band. The front face 3 covers the knot 1 in a known manner for forming the appearance of a Windsor knot. The front face 3 extends downwardly from the knot, in the direction of the bottom edges of the band 28 and 29. The front face 3 has a length that is stylish for a tie on an average child. For example, the front face can extends by approximately thirteen inches from the bottom edge of the knot 14. The front face also has a width that tapers towards the knot in a manner that is stylish for a tie on an average child. For example, the width of the tie on the bottom can have a maximum dimension of approximately three inches, and can taper on the top, by the knot, to approximately an inch and a half.

Figure 8A:
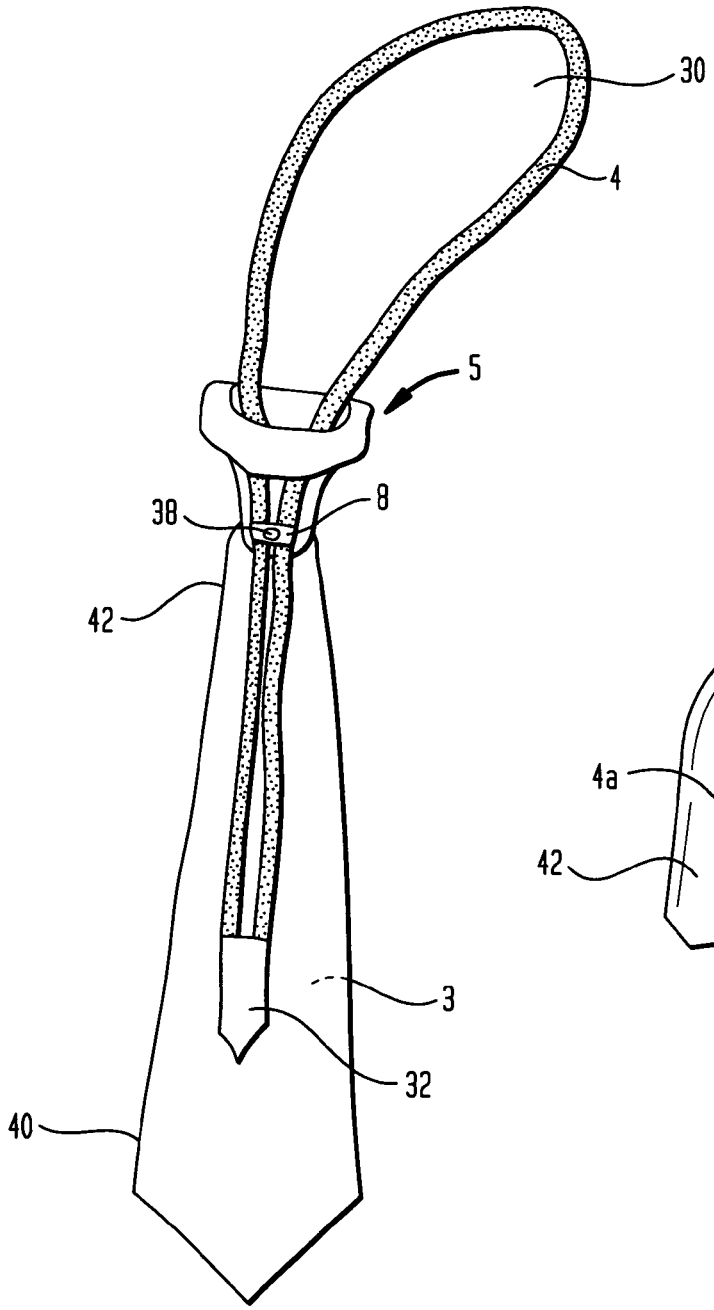
FIG. 8*a* is a rear view of all of the components, with FIG. 8*b* being an enlarged view of the top portion of the necktie and the bottom portion of the channel.
Figure 8B:
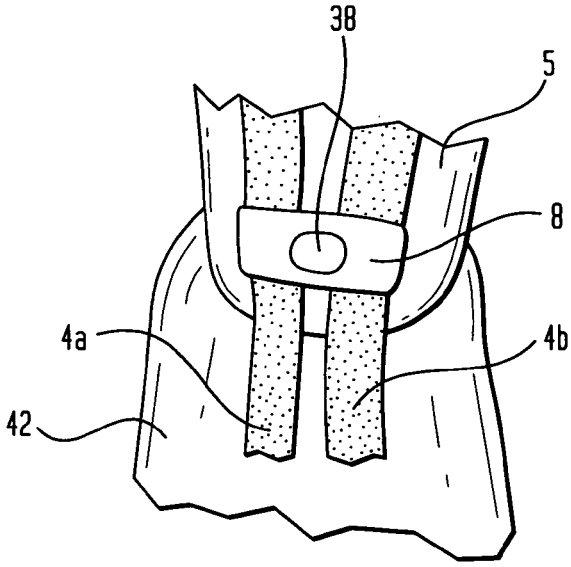
FIG. 8 is a rear view of the necktie after assembly of the components, but before tying of the knot around the channel.

Thus, in the preferred embodiment, as shown in FIG. 8, a length of material is provided as with a standard necktie, with the length of material having a bottom end 40 which is traditionally shaped to form the front face 3 of the necktie, and a top end 42 (which is used to form the knot 2). The band 4 is threaded through at least one channel 5, so that the band loops to form an opening 30 on top. A stud 38 (or stitching or other suitable means) is used to affix an elastic fabric member 8 to the channel, with the band 4 being threaded between the elastic member 8 and the channel 5 as described above. The stud 38 preferably extends through the material of the channel 5 and then through the top end 42 of the necktie (the end of the length of material used to make up the knot). Thus, the stud affixes the elastic member to the channel 5, and the channel 5 to the top end 42 of the necktie. The top end 42 is then wrapped or tied around the channel 5 to form the knot 2 with the band 4 extending out of the channel and the knot. The band extends out of the top of the knot as a loop (for placement around the neck), with the left and right circumferential segments 4*a* and 4*b* of the band extending out of the bottom of the knot, and ending in a hand grip which the user pulls to decrease the size of the loop.

Accordingly, there has been described a simulated necktie having a knot, a front face and a band. The necktie includes a front display face that is integral with the knot. The necktie presents appearance of a hand-tied necktie from both the front and the back upon casual examination. The band includes two segments, wherein the two segments are slipped through the knot to form a opening for the neck of the user. The two segments of the band are each capable of sliding through the knot for the purpose of increasing or decreasing the opening. The band is independently adjustable from the front face of the tie so that the length of the front piece is independent of the size of the user's neck. The front face of the tie is preset to a suitable length for the intended user (whether adult or child) and can be provided in multiple desired lengths to accommodate users of different heights. This avoid the need for the user to have to retie the tie knot multiple times to avoid having a front face of which is excessively long or too short. The band is also independently adjustable from the knot, so that adjustment of the band does not affect the knot's size or appearance.

The necktie is, therefore, removable from the head of a person without using a clasp affixed to the back outer surface of the knot (such clasps having previously been used for attachment of the necktie to the shirt collar). Nor is a clasp provided on the band for lengthening or shortening the length of the band. By avoiding a clasp on the band and on the knot, a design is provided in which the metal clip does not rest against the user's neck (which would potentially provide the user with discomfort).

The front face of the necktie and the knot are a continuous length of material, with the band being a separate length of material. The band is preferably a continuous length of material forming a closed loop, wherein the band has two segments that are capable of sliding through a channel placed in the knot. The band preferably further includes a length of material at its end portion forming a hand grip, located at the bottom of the band (below the knot) for the user to grasp, and for assisting in the tightening of the band. Thus, the two segments of the band extend through and below the knot, providing the appearance of a split section below the knot (an appearance somewhat analogous to a forked tongue). These two segments (the split section) are joined at the end, that joined end portion being called the hand grip.

The invention further includes an elastic member, located within the knot, for gripping and releasing the band. The elastic member is preferably affixed to the channel, and facilitates the positioning of the band in a stable position which will not slide through the knot except when intentionally adjusted by the user.

The present invention may be embodied in other specific forms without departing from its spirit or essential characteristics. The described embodiments are to be considered in all respects only as illustrative and not as restrictive. The scope of the invention is, therefore, indicated by the appended claims and their combination in whole or in part rather than by the foregoing description. All changes that come within the meaning and range of equivalency of the claims are to be embraced within their scope.

What is claimed is:

1. A necktie assembly, comprising:

a necktie, said necktie comprising a knot, a first channel and a second channel;

an insert placed inside said knot, said insert comprising said first channel;

a band, said band being a length of material separate from said knot which extends through said knot and through said first channel and said second channel; and, at least one elastic member inside said knot, wherein said elastic member to restrain the motion of said band within first channel;

and wherein said elastic member is secured to said insert.

2. A necktie assembly, as claimed in claim 1, having a front display face, said front display face and said knot being a continuous material.

3. A necktie assembly, as claimed in claim 1, wherein said knot is a fabric and said insert is fabricated from a material more rigid than said fabric.

4. A necktie assembly, as claimed in claim 3, wherein:

(a) said at least one elastic member is attached to said insert so as to provide an elastic member left channel and an elastic member right channel;

(b) wherein said band comprises a left segment and a right segment; and (c) wherein said left segment of said band is threaded through said elastic member left channel and said right segment of said band is threaded through said elastic member right channel.

5. A necktie assembly, as claimed in claim 3, wherein said band comprises a bottom segment forming a hand grip.

6. A necktie assembly, as claimed in claim 4, wherein said insert comprises a front face and a rear face; and wherein each of said front face and said rear face comprises a top edge, a bottom edge and a pair of side edges.

7. A necktie assembly, as claimed in claim 6, wherein the top and side edges of each of said faces is contoured as a Windsor knot.

8. A necktie assembly, as claimed in claim 6, wherein the side edges on said front and rear faces are tapered, and wherein said taper on said rear face is the same as said taper on said front face.

9. A necktie assembly, as claimed in claim 6, where said elastic member is connected to the inside of said front face of said insert, adjacent to said bottom edge of said front face of said insert.

10. A necktie assembly, as claimed in claim 9, wherein said bottom edge of said rear face is offset from said bottom edge of said front face by the height of said elastic member.

11. A necktie assembly, as claimed in claim 9, wherein said elastic member is fabricated from spandex.

12. A necktie assembly, as claimed in claim 9, wherein said insert is fabricated from plastic.

13. A necktie assembly, as claimed in claim 9, wherein said elastic member is connected to said insert via a bolt, or stitching, or fabric welding.

14. A necktie assembly, as claimed in claim 4, wherein said at least one elastic member comprises two elastic members, a first elastic member and a second elastic member, and wherein said elastic member left channel is a channel formed between said first elastic member and said insert, and said elastic member right channel is a channel formed between said second elastic member and said insert.

15. A necktie assembly, comprising:

a necktie, said necktie comprising a knot, a first channel, and a second channel;

an insert placed inside said knot, said insert comprising said first channel, wherein said insert is of a shape and sufficient rigidity to maintain the shape of said knot;

a band, said band being a length of material separate from said knot which extends through said knot and through said first channel and said second channel, said band having two segments, each of said segments being threaded through said first channel, each of said segments being capable of sliding within said first channel; and, at least one elastic member inside said knot, wherein said elastic member to restrain the motion of said band through said first channel;

and wherein said elastic member is secured to said insert.

16. A necktie assembly, as claimed in claim 15, having a front display face, said front display face and said knot being a continuous material.

17. A necktie assembly, as claimed in claim 15, wherein said knot is a fabric and said insert is fabricated from a material more rigid than said fabric.

18. A necktie assembly, as claimed in claim 17, wherein:

(a) said at least one elastic member is attached to said insert so as to provide an elastic member left channel and an elastic member right channel;

(b) wherein said two segments of said band are a left segment and a right segment of said band; and (c) wherein said left segment of said band is threaded through said elastic member left channel and said right segment of said band is threaded through said elastic member right channel.

19. A necktie assembly, as claimed in claim 17, wherein said band comprises a bottom segment forming a hand grip.

20. A necktie assembly, as claimed in claim 18, wherein said channel comprises a front face and a rear face; and wherein each of said front face and said rear face comprises a top edge, a bottom edge and a pair of side edges.

21. A necktie assembly, as claimed in claim 20, wherein the top and side edges of each of said faces is contoured as a Windsor knot.

22. A necktie assembly, as claimed in claim 20, wherein the side edges on said front and rear faces are tapered, and wherein said taper on said rear face is the same as said taper on said front face.

23. A necktie assembly, as claimed in claim 20, where said elastic member is connected to the inside of said front face of said insert, adjacent to said bottom edge of said front face of said insert.

24. A necktie assembly, as claimed in claim 22, wherein said bottom edge of said rear face is offset from said bottom edge of said front face by the height of said elastic member.

25. A necktie assembly, as claimed in claim 23, wherein said elastic member is fabricated from spandex.

26. A necktie assembly, as claimed in claim 23, wherein said insert is fabricated from plastic.

27. A necktie assembly, as claimed in claim 23, wherein said elastic member is connected to said insert via a bolt, or stitching, or fabric welding.

28. A necktie assembly, as claimed in claim 18, wherein said at least one elastic member comprises two elastic members, a first elastic member and a second elastic member, and wherein said elastic member left channel is a channel formed between said first elastic member and said insert, and said elastic member right channel is a channel formed between said second elastic member and said insert.

29. A necktie assembly as claimed in claim 1, wherein said second channel is a channel in said elastic member.

30. A necktie assembly as claimed in claim 15, wherein said second channel is a channel in said elastic member.

* * * * *